US006390590B1

(12) United States Patent
Hansburg

(10) Patent No.: US 6,390,590 B1
(45) Date of Patent: May 21, 2002

(54) APPARATUS FOR RECORDING INFORMATION ABOUT AN INK CARTRIDGE

(75) Inventor: Edward Michael Hansburg, Wayne, PA (US)

(73) Assignee: Oki Data Americas, Inc., Mount Laurel, NJ (US)

( * ) Notice: Subject to any disclaimer, the term of this patent is extended or adjusted under 35 U.S.C. 154(b) by 0 days.

(21) Appl. No.: 09/483,909

(22) Filed: Jan. 18, 2000

Related U.S. Application Data

(60) Provisional application No. 60/116,550, filed on Jan. 21, 1999.

(51) Int. Cl.[7] ..... B41J 29/38; B41J 2/195; B41J 29/393

(52) U.S. Cl. ..... 347/19; 347/5; 347/7

(58) Field of Search ..... 347/19, 7, 86; 73/306, 305

(56) References Cited

U.S. PATENT DOCUMENTS

| | | | | | |
|---|---|---|---|---|---|
| 3,659,458 | A | * | 5/1972 | Bice et al. | 73/306 |
| 4,422,085 | A | | 12/1983 | Sumitomo et al. | 347/7 |
| 4,456,916 | A | | 6/1984 | Kocot | 347/87 |
| 4,554,494 | A | * | 11/1985 | Howeth | 73/305 |
| 4,626,874 | A | | 12/1986 | Murai et al. | 347/86 |
| 4,881,088 | A | * | 11/1989 | Fisher, Jr. et al. | 73/305 |
| 4,889,442 | A | | 12/1989 | Takagi et al. | 401/194 |
| 5,054,319 | A | * | 10/1991 | Fling | 73/305 |
| 5,079,570 | A | | 1/1992 | Mohr et al. | 347/7 |
| 5,184,181 | A | * | 2/1993 | Kurando et al. | 399/262 |
| 5,406,315 | A | * | 4/1995 | Allen et al. | 347/7 |
| 5,434,603 | A | * | 7/1995 | Hunt | 347/7 |
| 5,574,484 | A | | 11/1996 | Cowger | 347/7 |
| 5,610,635 | A | | 3/1997 | Murray et al. | 347/7 |
| 5,691,750 | A | | 11/1997 | Edwards | 347/7 |
| 5,712,667 | A | | 1/1998 | Sato | 347/7 |
| 5,774,136 | A | | 6/1998 | Barbehenn et al. | 347/7 |
| 5,788,388 | A | | 8/1998 | Cowger et al. | 400/703 |
| 5,812,156 | A | * | 9/1998 | Bullock et al. | 347/19 |
| 6,024,428 | A | * | 2/2000 | Uchikata | 347/7 |
| 6,053,597 | A | * | 4/2000 | Hirota | 347/19 |
| 6,164,743 | A | * | 12/2000 | Hmelar et al. | 347/7 |

* cited by examiner

*Primary Examiner*—John Barlow
*Assistant Examiner*—An H. Do
(74) *Attorney, Agent, or Firm*—Akin, Gump, Strauss, Hauer & Feld, L.L.P.

(57) ABSTRACT

An apparatus for recording information about an ink cartridge installed in a printing mechanism is disclosed. The apparatus includes an indicator internal to the ink cartridge for providing the information about the ink cartridge, a sensor, external to the ink cartridge, for receiving the information from the indicator; and a controller for receiving the information from the sensor and storing the information.

43 Claims, 4 Drawing Sheets

APPARATUS FOR RECORDING INFORMATION ABOUT AN INK CARTRIDGE

CROSS REFERENCE TO RELATED APPLICATIONS

This application claims the benefit of U.S. Provisional Application No. 60/116,550, filed Jan. 21, 1999, entitled Method and Apparatus for Ink Level Detection.

BACKGROUND OF THE INVENTION

This invention relates generally to ink jet printers and more particularly to monitoring the quantity of ink in the ink cartridges of an ink jet printer.

The typical ink jet printer employs a print head assembly, comprising one or more ink cartridges, mounted on a carriage assembly. Each ink cartridge comprises an ink reservoir and a printhead formed with very small nozzles through which ink drops are dispensed. The print head assembly is moved laterally back and forth over the width of a sheet of paper or other print media by the carriage assembly to dispense the ink drops from the nozzles onto the print media in patterns determined by electrical control signals from a printer controller.

Ink jet printers typically have a cleaning station usually located at one extreme of the carriage travel for cleaning of the printhead nozzles. The carriage assembly periodically returns to the cleaning station after a predetermined amount of ink has been dispensed from the ink cartridges.

There are, typically, four ink cartridges in color ink jet printers, the individual ink cartridges holding cyan, magenta, yellow and black ink. Each color is likely to be dispensed at a different rate depending upon the type of images being printed. It is desirable for a user to know the quantity of the ink in each ink cartridge at any given time. This allows a user to refill or replace a cartridge prior to the cartridge becoming completely empty, avoiding a defective print job or damage to a printhead.

It is also useful to log the ink consumption of each ink cartridge over time and/or in relation to each print job in order to compute the ink consumption and cartridge replacement information, cost per page information etc. The ink consumption information is useful to both the user, for estimating purchasing/stock requirements and cost analysis etc., and to the manufacturer of the ink cartridge to improve its marketing/distribution/customer support operations.

A variety of approaches have been proposed for measuring the quantity of ink in ink jet cartridges installed in ink jet printers. U.S. Pat. No. 5,079,570 describes an ink level sensor employing a light beam for detecting the level of ink in a cartridge employing a capillary ink reservoir. However, the sensor is capable of detecting only whether or not the ink is above or below a certain level in the cartridge. U.S. Pat. Nos. 5,610,635 and 5,691,750 each disclose a technique for estimating the amount of ink remaining in an ink jet printer ink cartridge based upon the fluid volume of a dispensed ink drop and the number of times the printhead is energized to dispense the ink. U.S. Pat. Nos. 5,788,388 and 5,712,667 each disclose an ink level sensor in which a light emitting diode and a light detector are arranged across a sump at the bottom of an ink cartridge to detect when the ink in the sump falls below a selected level. U.S. Pat. No. 5,744,136 discloses a means for directly measuring the ink level in an ink cartridge by measuring the transit time of an ultrasonic pulse transmitted through the ink in the ink cartridge. All of the aforementioned approaches suffer from either an inability to directly measure the actual level of ink in an installed ink cartridge or from excessive complexity.

Accordingly there is a need for an accurate, economical and reliable means for automatically measuring and recording the quantity of the ink in an ink jet printer ink cartridge while the ink cartridge is installed in an ink jet printer. There is further a need for a user to be able to determine the ink level by visual inspection of the cartridge. In addition, there is a need to automatically read and store information placed on the cartridge by the manufacturer to identify specific information about each cartridge. None of the above prior art methods provide all of these features.

The present invention is directed to a ink detection apparatus for periodically and automatically measuring the quantity of ink stored in an ink jet printer cartridge while the ink cartridge is installed in a printing mechanism. The invention further provides a means for automatically reading manufacturer information codes from each ink cartridge, means for storing the ink level information and manufacturer information codes in the printer memory or in a connected computer memory and means for logging cartridge ink consumption and generating ink consumption statistics for use by users and manufacturers.

BRIEF SUMMARY OF THE INVENTION

Briefly stated the present invention is an apparatus for recording information about an ink cartridge installed in a printing mechanism comprising: an indicator internal to the ink cartridge for providing the information about the ink cartridge; a sensor, external to the ink cartridge, for receiving the information from the indicator; and a controller for receiving the information from the sensor and storing the information.

The present invention further comprises an apparatus for determining information about an ink cartridge installed in a printing mechanism comprising: a carriage assembly reciprocating on a carriage guide rod, the ink cartridge being mounted on the carriage assembly for movement therewith, the ink cartridge including a rear wall and an ink reservoir for holding a quantity of ink; a movable indicator located within the ink cartridge, the indicator having a surface adjacent to the rear wall of the ink cartridge, the indicator, by its location in the ink cartridge, providing information about the ink cartridge; and a sensor for receiving the information from the indicator about the ink cartridge.

The present invention further comprises an ink cartridge for a printing mechanism comprising: a reservoir holding ink and a movable indicator internal to the ink cartridge, a location of the indicator corresponding to the quantity of ink in the reservoir.

BRIEF DESCRIPTION OF THE SEVERAL VIEWS OF THE DRAWINGS

The foregoing summary as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
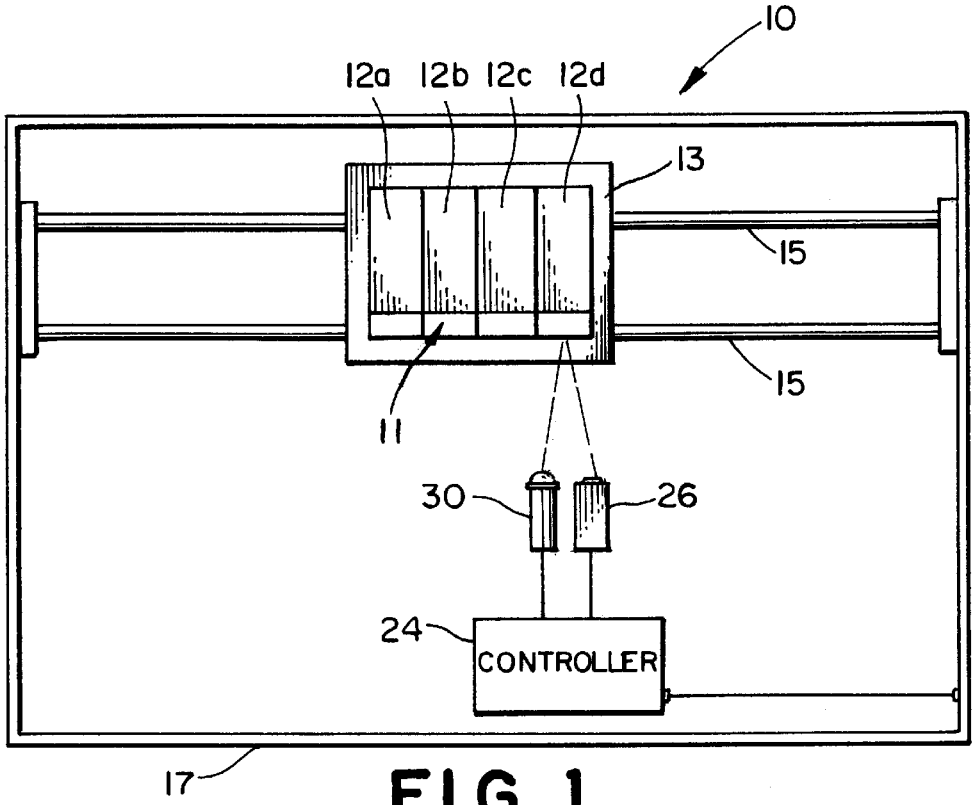
FIG. 1 is a top view of a portion of a printing mechanism in accordance with the present invention.

Referring to the drawings, wherein like numerals are used to indicate like elements throughout the several figures and the use of the indefinite article "a" may indicate a quantity of one or more than one of an element, there is shown in FIG. 1 an apparatus 10 for recording information about one or more ink cartridges 12 installed in a printing mechanism 17. The apparatus 10 comprises the ink cartridges 12, an indicator 16 (not shown) in each ink cartridge 12 for indicating the information, a sensor 26, external to the ink cartridge 12 for receiving the information from the indicator 16 and a controller 24 in the printing mechanism 17 for receiving the information from the sensor 16 and recording the information. The information comprises a quantity of ink in each ink cartridge 12 and manufacturing information.

Figure 2:
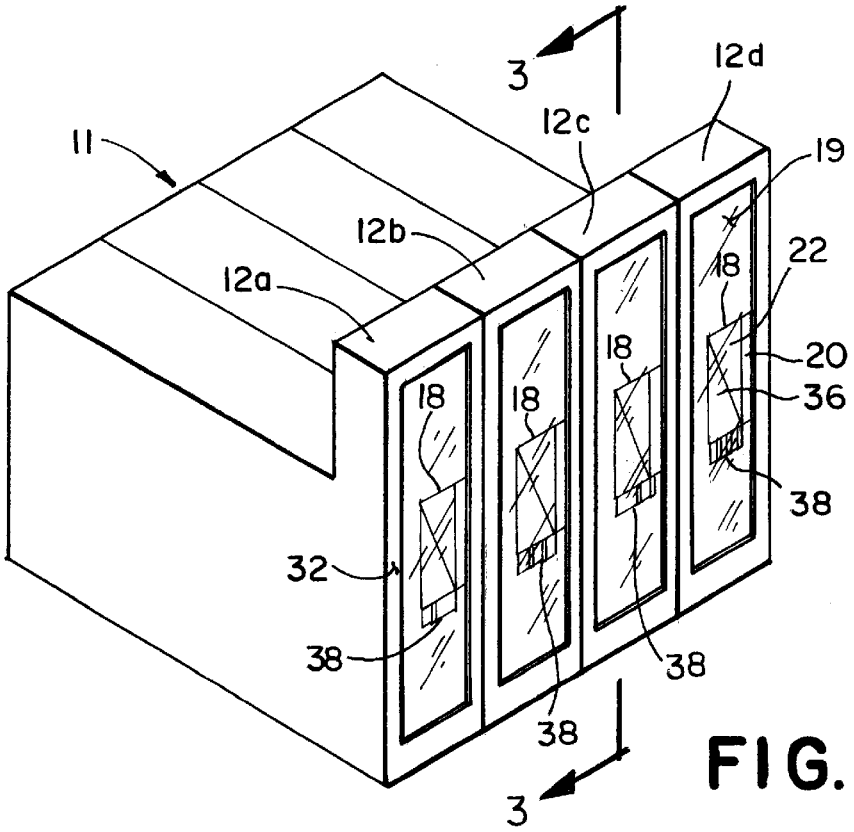
FIG. 2 is a perspective view of a of a print head assembly in accordance with a first preferred embodiment of the present invention.
Figure 3:
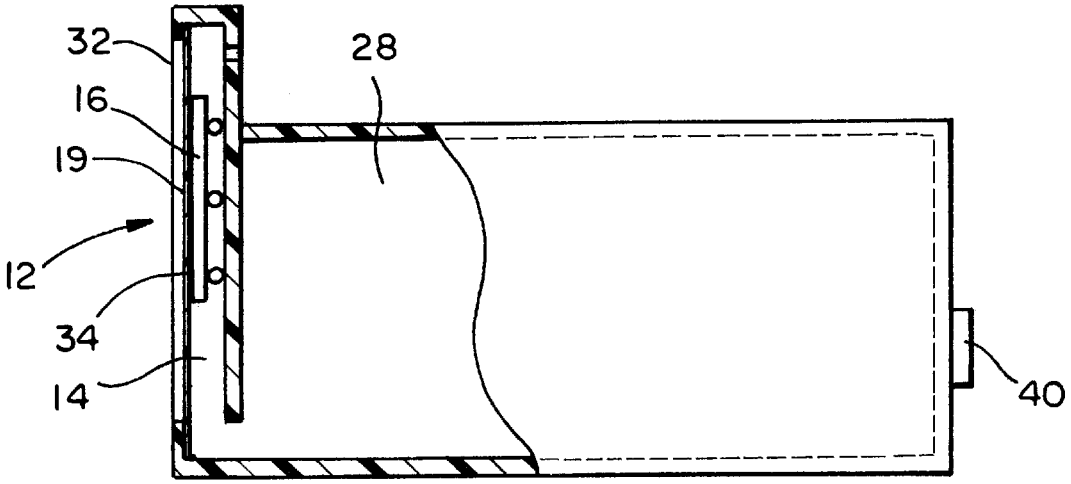
FIG. 3 is a sectional view of an ink cartridge taken along line 3—3 of FIG. 2.

Referring now to FIGS. 1–3, there is shown a first preferred embodiment of the present invention comprising: (1) a carriage assembly 13 reciprocating on a carriage guide rod 15, (2) a print head assembly 11 including one or more ink cartridges 12 mounted on the carriage assembly 13, each ink cartridge holding a quantity of ink in a reservoir 28 and having a rear wall 32; (3) a movable indicator 16 located within the ink cartridge 12, the indicator 16 having a surface 34 adjacent to the rear wall 32 of the ink cartridge and providing information about the ink cartridge 12; a light emitter 30 fixedly mounted relative to the movable indicator 16 and (4) a sensor 26, for receiving information about the ink cartridge 12.

In the first preferred embodiment, the print head assembly 11 comprises four individual ink cartridges 12*a*, 12*b*, 12*c*, 12*d*, containing respectively cyan, magenta, yellow and black ink in which each ink cartridge 12*a*, 12*b*, 12*c*, 12*d* is separately removable from the print head assembly 11 for replacement or maintenance. The print head assembly 11 may also provide for dispensing the four inks (cyan, magenta, yellow and black) from a cartridge 12 of unitary construction within the spirit and scope of the invention. The ink cartridges 12*a*, 12*b*, 12*c*, 12*d* are generally parallelepiped in shape and are mounted in a side-by-side abutting relationship on the carriage assembly 13. The ink cartridges 12 are preferably molded of a polymeric material. However, as will be appreciated by those skilled in the art, the ink cartridges 12 may be fabricated from other materials and by other methods and may contain inks of other colors and still be with the spirit and scope of the invention.

As seen in FIG. 3 each ink cartridge 12*a*, 12*b*, 12*c*, 12*d* comprises a printhead (not shown) containing ink nozzles 40 for delivering ink to a print media such as paper (not shown), and an ink reservoir 28 for storing the ink. In the first preferred embodiment, each ink cartridge 12 also includes a channel 14, molded adjacent to the inside of a rear wall 32 of each cartridge 12*a*, 12*b*, 12*c*, 12*d*. The channel 14 is fluidly connected to the reservoir 28 for receiving a portion of the ink such that the level of the ink in the channel 14 corresponds to the level or quantity of ink in the reservoir 28. The channel 14 retains the movable indicator 16 captive and guides the indicator 16 for movement in an up and down direction depending upon the level or quantity of ink in the reservoir 28. The width and depth of the channel 14 are such that the indicator 16 is free to move up and down as the level of the ink in the channel 14 changes without binding the indicator 16, even when the channel 14 is not perfectly vertical.

In the first preferred embodiment, the indicator 16 is a float device having a specific gravity which is less than the specific gravity of the ink. The float device 16 thereby floats up and down on the ink in the channel 14 and attains a location corresponding to the level of the ink in the channel 14. Since the level of the ink in the channel 14 corresponds to the quantity of ink in the reservoir 28, at any instant of time, the location of the float device 16 provides an accurate indication of the quantity of ink in the reservoir 28. As will be appreciated by those skilled in the art, the indicator 16 need not be held captive in the channel 14 provided that it is maintained in such a way as to travel in a consistent path as the quantity of ink in the reservoir 28 changes and is adjacent to the rear wall 32 of the cartridge 12. For example, a float device 16 attached to the end of a pivotable lever within the cartridge 12 and capable of moving up and own in response to the quantity of ink in the reservoir 28 of the cartridge 12 is within the spirit and scope of the invention.

In the first preferred embodiment, the float device 16 is made of a solid polymeric foam. However, as will be appreciated by those skilled in the art, the float device 16 could be fabricated in a variety of ways and from a variety of materials, including hollow, airtight construction of metal or some other polymeric material, and still be within the spirit and scope of the invention.

In the first preferred embodiment, the sensor 26 is a light sensor. At least a portion of the rear wall 32 of each cartridge 12 includes a window 19 which is transparent to light so that light rays directed at the rear wall 32 of each cartridge 12 by the light emitter 30 penetrate into the interior of each cartridge 12 to illuminate a surface 34 of the float device 16. The transparent window 19 also makes it possible for the user to visually determine the location of the indicator 16. The surface 34 of the float device 16 preferably includes an ink quantity code pattern 18 and a predetermined code pattern 38. Light reflected from the code patterns 18, 38 on the surface 34 of the float device 16 are detected by the light sensor 26 as the carriage assembly 13 reciprocates on the carriage guide rod 15.

In the first preferred embodiment, the location of the float device 16 in the channel 14 is determined by detecting the light reflected from the ink quantity code pattern 18 by the light sensor 26. The ink quantity code pattern 18 includes a light reflecting leading edge marker 20 of constant width extending vertically over a first side portion of the surface 34 of the float device 16. Adjacent to the leading edge marker 20 and extending vertically along the surface 34 of the float device 16 is a non-reflecting ink level detecting area 22. The width of the ink level detecting area 22 varies linearly from a substantially zero width near the bottom of the float device 16 to being substantially the full width of the remainder of the surface 34 of the float device 16 near the top of the float device 16. Adjacent to the non-reflecting area 22 and on a second side portion of the surface 34 of the float device 16 opposite to the leading edge marker 20 is a light reflecting trailing edge marker 36, the width of the trailing edge marker 36 being complementary to the width of the ink detecting area 22 and extending generally vertically over the second side portion of the surface 34. As will be appreciated by those skilled in the art, the leading edge and trailing edge markers 20, 36 could be made nonreflecting and the ink detecting area 22 reflecting and still be within the spirit and scope of the invention.

Figure 4:
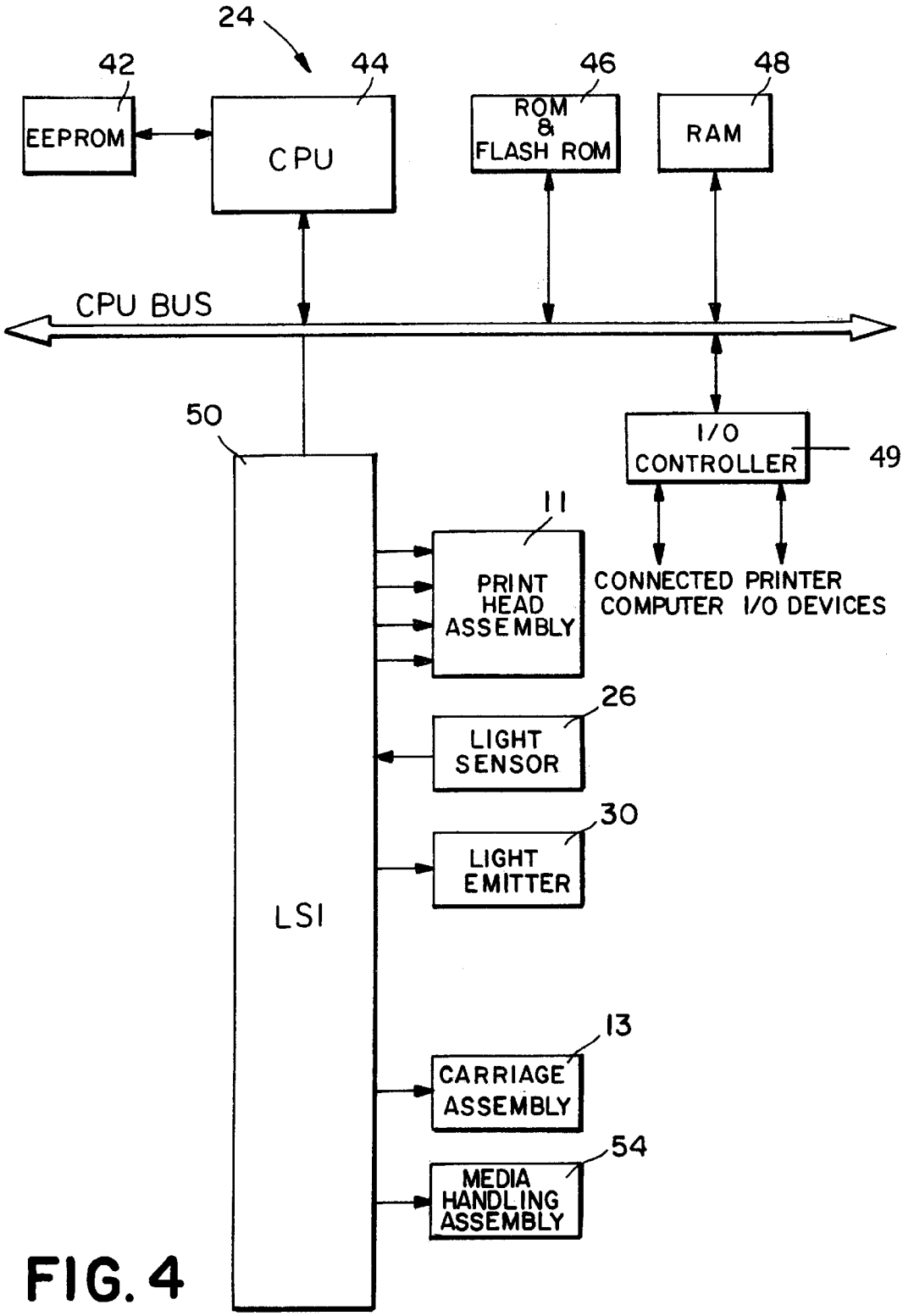
FIG. 4 is a schematic functional block diagram of a controller of an ink jet printer employing the print head assembly of FIG. 2.

In use the carriage assembly 13 reciprocates on a carriage guide rod 15 to move the print head assembly 11 transversely across the width of the print media held captive by a media handling assembly 54 (shown schematically in FIG. 4). The media handling assembly 54 transports the media longitudinally past the print head assembly 11. The print head assembly 11, media handling assembly 54 and carriage assembly 13 are under the control of the controller 24 (FIG. 4). At one end of the carriage guide rod 15 is a cleaning station (not shown) to which location the print head assembly 11 is periodically moved for printhead maintenance. The print head assembly 11 moves with a predetermined, substantially constant velocity when traversing the carriage guide rod 15 into the cleaning station. The carriage assembly 13, carriage guide rod 15, cleaning station and media handling assembly 54 are of conventional design and well known in the art and need not be described in detail for a full understanding of the invention.

In the first preferred embodiment, the light emitter 30 and the light sensor 26 are fixedly mounted to the printing mechanism 17 proximate to the cleaning station (see FIG. 1). The light emitter 30 and the light sensor 26 are situated so that light emitted from the light emitter 30 is directed at the rear wall 32 of the cartridges (32*a*, 32*b*, 32*c*, 32*d*) and is reflected by the leading edge marker 20 and trailing edge marker 36 into the light sensor 26 when the print head assembly 11 moves past the light emitter 30 and light sensor 26 into the cleaning station. As will be appreciated by those skilled in the art the method of ink level detection does not depend on the detection of the aforementioned patterns 18, 38 on the float device 16 being performed proximate to the cleaning station. The light emitter 30 and light sensor 26 may be located at any point along the path of movement of the carriage assembly 13 and ink level detection can be performed at any location along the carriage assembly 13 path and still be within the spirit and scope of the invention. Furthermore, as will be appreciated by one skilled in the art the light emitter 30 and light sensor 26 need not be fixed mounted with respect to the movement of the carriage assembly 13 as in the first embodiment. The light sensor 26 and light emitter 30 could be mounted on the carriage assembly 13 and provided with a scanning mechanism for scanning the ink quantity code pattern 18 and still be within the spirit and scope of the invention.

The light emitter 30 is preferably a light emitting semiconductor diode which emits light of a predetermined wavelength. However, it will be appreciated by one skilled in the art that other types of light emitters, including thermionic light emitters or gas discharge light emitters may be used within the sprit and scope of the invention. The light sensor 26 is preferably a photodiode which converts detected light to electrical signals. In the preferred embodiment, the electrical signals output by the light sensor 26 are amplified and are subjected to a threshold level for converting the output signal of the sensor 26 to a binary signal suitable for input to the controller 24. The light sensor 26 may also include an optical filter tuned to the wavelength of light emitted by the light emitter 30 for eliminating stray light. While the light sensor 26 is preferably a photodiode, it will be appreciated by one skilled in the art that the light sensor 26 is not limited to being a photodiode. Other types of light sensors, such as photo-conductors, may be employed as the light sensor 26 within the spirit and scope of the invention.

Preferably, as shown in FIG. 2, the surface 34 of the float device 16 also includes a horizontally disposed predetermined code pattern 38 of alternating light reflecting and non-reflecting areas located at the bottom of the surface 34. When a cartridge 12 is full of ink, the float device 16 rises in the channel 14 to its fullest vertical extent, thereby aligning the predetermined coded pattern area 38 in the path of the light emitted from the light emitter 30 when the carriage assembly 13 traverses the carriage guide rod 15 into the cleaning station. The predetermined code pattern 38 is thus detected by the light sensor 26 as the carriage assembly 13 moves into (or out of) the cleaning station. The predetermined code pattern 38, detected by the light sensor 26 and converted to a pulse train by the light sensor 26 is input to the controller 24 for processing according to a computer program residing in the controller 24.

In the first preferred embodiment, the predetermined code pattern 38 encodes manufacturing information including but not limited to the name of the manufacturer of the cartridge 12, the manufacturing batch number of the cartridge 12, the date of manufacture of the cartridge 12 and the color of the ink in the cartridge 12. The predetermined code pattern 38 has suitable synchronization and validity coding in order to reliably detect the manufacturing information and to distinguish the manufacturing information from other signals. Since the predetermined code pattern 38 is within the beams of the light emitter 30 and light detector 26 only when the ink cartridge 12 is substantially full, the decoding of a valid manufacturer information code is a reliable indication that the cartridge 12 is full of ink in addition to providing the manufacturing information. In particular, replacing a spent cartridge 12 with a full cartridge 12 is automatically registered in the printer.

When the ink cartridge 12 is not full of ink, the float 16 is not at its fullest vertical extent in the channel 14, thus situating the ink quantity code pattern 18 in the beam of the light emitter 30 and the light sensor 26 as the carriage assembly 13 traverses the carriage guide rod 15. As a consequence of the carriage assembly 13 traveling at a substantially constant velocity, the light sensor 26 provides pulse outputs of predetermined duration to the controller 24 corresponding to detecting the light reflected from the leading edge marker 20 and the trailing edge marker 36 of the ink quantity code pattern 18. If the time duration of the leading edge marker pulse falls within a predetermined range, the controller 24 uses the leading edge marker pulse as a synchronization pulse for subsequently determining the time duration between the occurrence of the trailing edge of the leading edge marker 26 and the leading edge of the trailing edge marker 36, i.e. the width of the ink level detection area 22. Since the width of the ink detecting area 22 increases linearly over the vertical extent of the float 16, the time duration between the leading and trailing edge pulses is proportional to the location of the float 16 in the channel 14.

Figure 5:
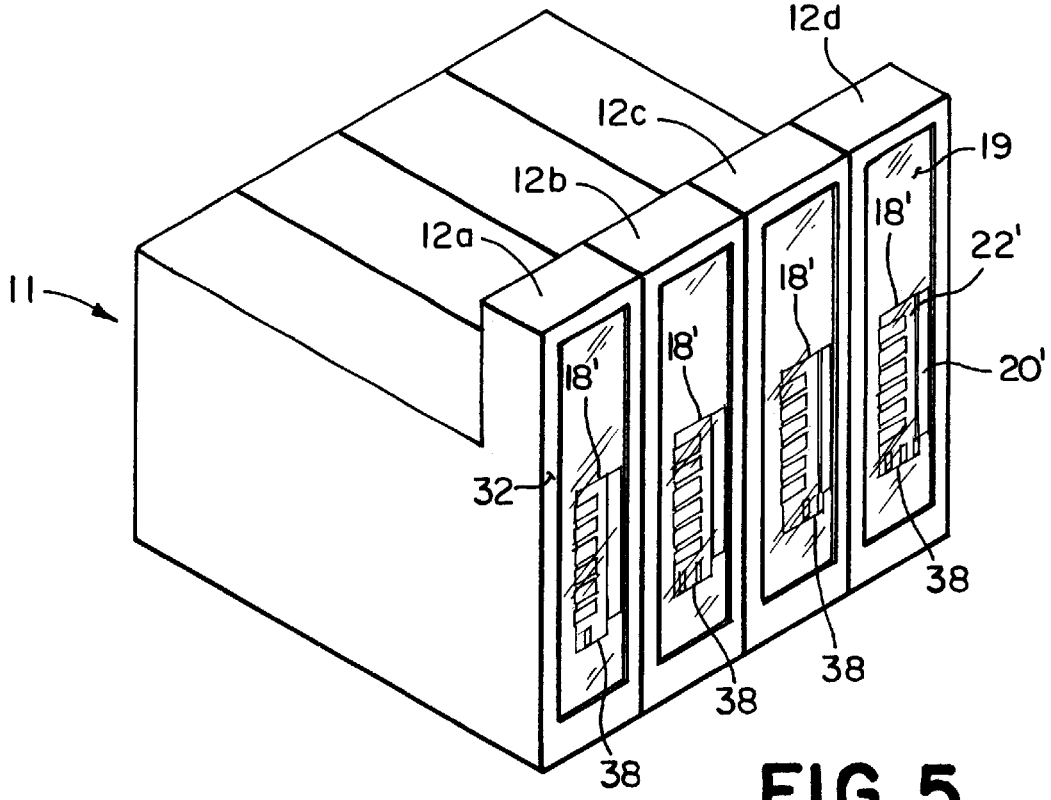
FIG. 5 is a is a perspective view of the print head assembly in accordance with a second preferred embodiment of the present invention.

In a second preferred embodiment of the invention, shown in FIG. 5., the ink quantity code pattern 18' on the surface 34 of the float device 16 comprises: (1) a reflecting leading edge marker 20' of constant width extending vertically over the first side of the surface and (2) an ink detecting area 22' comprising a series of horizontally disposed patterns of alternating light reflecting and non-reflecting areas having distinct binary number equivalents. The horizontally disposed code patterns are arranged one above the other, such that the vertical location of the float device 16 in channel 14 may be determined by decoding the distinct pattern corresponding to the particular level of the ink in the channel 14 as one of the horizontal code patterns in the light detecting area 22' as the carriage assembly 13 passes in front of the light emitter 30 and light detection sensor 26. It will be appreciated by one skilled in the art that the specific means for coding the vertical location of the float device 16 is not limited to the two specific ink level detecting area 22, 22' patterns discussed in the first and second embodiments. Any pattern on the surface 34 of the float device 16, which when scanned by a sensor 16 to provide an unambiguous indication of the location of the float device 16 in the ink cartridge 12 is within the spirit and scope of the invention.

Figure 6:
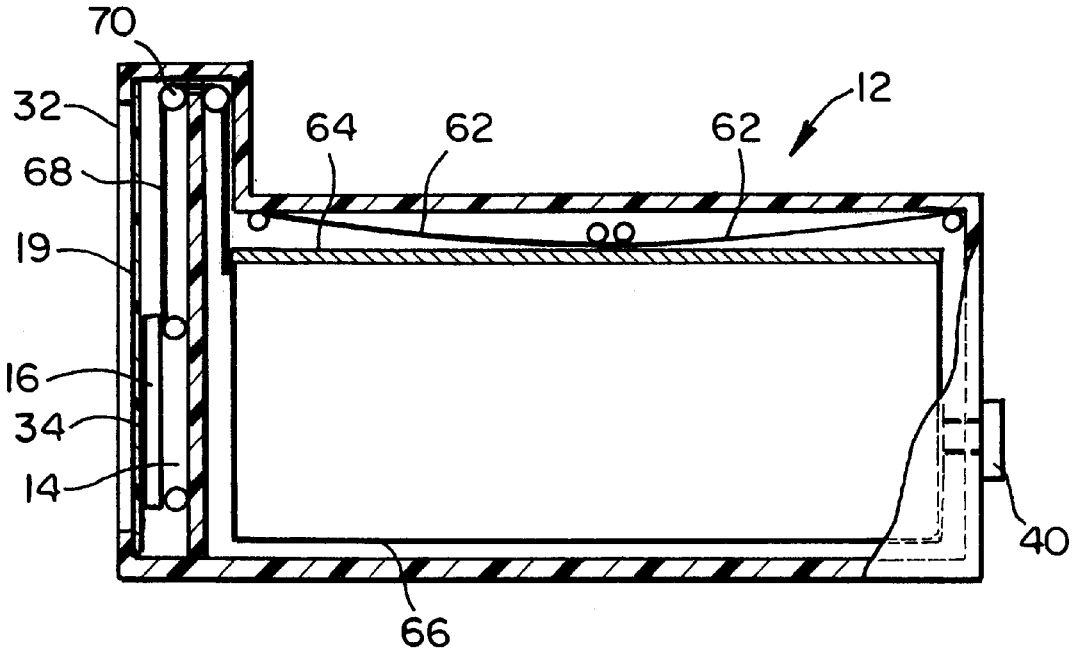
FIG. 6 is a side view of an ink cartridge in accordance with a third embodiment of the present invention.

In a third embodiment of the present invention, shown in FIG. 6, the ink cartridge 12 includes a sealed ink bag 66 made of a polymeric material for holding the ink. A pressure plate 64 is attached to the top of the ink bag 66 upon which negative pressure springs 62 exert a force to move the pressure plate 64 downward as the ink is dispersed from the ink bag 66. The indicator 16 is attached to the pressure plate 64 by an attachment strip 68 which rides over bearings 70. As the ink is dispensed from the ink bag 66, the indicator 16 attains a location within the ink cartridge 12 corresponding to the quantity of ink in the ink bag 66. As will be appreciated by those skilled in the art, the coded patterns 18, 38 on the surface 34 of the indicator 16 are identical to the first and second embodiments except that they are inverted, since the travel of the indicator 16 is opposite to the travel of the indicator 16 in the first and second embodiments.

As will be appreciated by those skilled in the art, the process of obtaining information about an ink cartridge 12 from an indicator 16 within the ink cartridge 12 need not be limited to detecting a light beam reflected from the indicator 16 by a light sensor 26. Instead of light reflecting and non-reflecting areas on the rear surface 34 of the float device 16, the float device 16 may be coded with magnetic patterns having the same general shapes as the light reflecting patterns previously described. In this case, no light emitter 30 would be required. A magnetic sensor such as, for example, a Hall effect device, could be used as a sensor 26 to detect the ink quantity code pattern 18 and the predetermined code pattern 38 and still be within the spirit and scope of the invention.

Referring now to FIG. 4, there is shown a schematic diagram of a printer controller 24 of conventional design incorporating a central processing unit (CPU) 44, an electronically erasable programmable read only memory (EEPROM) 42, a non-volatile read only memory (ROM), a flash ROM 46 and volatile random access memory (RAM) 48 and an I/O controller 49, employing commercially available electronic components. There is also shown, as included in the controller 24, a custom design large scale integrated circuit (LSI) 50 which interfaces the print head assembly 11, carriage assembly 13, media handling assembly 54, light emitter 30 and detection sensor 26 to the controller 24. The LSI circuit 50 accepts the electrical signals from the detection sensor 26, converts the electrical signals to binary logic level signals and decodes the electrical signals. In the case of the ink level detecting area 22 being an oblique pattern and generating a pulse width signal proportional to the ink level in the channel 14, a computer program operative in the LSI circuit 50 converts the time duration of the pulse width to an ink quantity. In the case where the ink quantity is detected by a code pattern, the computer program operative in the LSI circuit 50 translates each distinctive code pattern into a respective ink quantity. A computer program in the LSI circuit 50 also detects the predetermined code pattern 38 to extract manufacturer information associated with each print cartridge 12.

The controller 24 also includes a computer program that utilizes the ink quantity information and manufacturing information for purposes of providing the quantity of the ink and the manufacturing information for each ink cartridge 12 to a user upon request. In addition to merely recording and displaying the manufacturer information code and the ink level information, the computer program in the controller 24 is capable, for instance, of computing past ink usage by print job for each color of ink and estimating future ink cartridge 12 usage based on past usage. Thus, the print controller 24 is capable of developing a unique user/customer profile of ink consumption for each printer.

The information developed by the print controller 24 may be stored in both the printer flash ROM 46 of the controller 24 in the printing mechanism 10 and also in a memory of a connected computer (not shown). The information stored in the printing mechanism 10 is user accessible at the printing mechanism 10 for routine maintenance purposes and also by the printing mechanism's 10 manufacturing service/marketing organization to better understand it's customer base print usage environment and to improve its own marketing/customer support operations. The information is also retrievable at the connected computer for support of cost analyses and purchasing/stock requirements. It will be appreciated by those skilled in the art that the aforementioned are only examples of the types of processing that can be performed on the periodically measured and stored ink quantity information and manufacturing information. Such information developed by the print controller 24 to be used in a variety of ways to indicate past ink usage and predict future ink usage is within the spirit and scope of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus for recording information about an ink cartridge installed in a printing mechanism comprising:

a movable indicator internal to the ink cartridge for providing the information about the ink cartridge;

a sensor, external to the ink cartridge, for receiving the information from the indicator; and a controller for receiving the information from the sensor and storing the information.

2. The apparatus according to claim 1, wherein the information comprises a quantity of ink in the ink cartridge.

3. The apparatus according to claim 1, wherein the information comprises manufacturing information.

4. The apparatus according to claim 3, wherein the manufacturing information is located on the indicator such that the sensor receives the manufacturing information when the ink cartridge is substantially full of ink.

5. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator located wholly within the ink cartridge, the indicator having a surface directly adjacent to an inside surface of the rear wall of the ink cartridge, the indicator, by its location in the ink cartridge, providing information about the ink cartridge; and a sensor for receiving the information from the indicator about the ink cartridge.

6. The apparatus according to claim 5, wherein the sensor is a light sensor and a portion of the rear wall of the ink cartridge is transparent, the apparatus further including a light emitter emitting light whereby the light emitter illuminates the surface of the indicator with the light and the sensor detects light reflected from the surface of the indicator as the carriage reciprocates on the carriage guide rod.

7. An apparatus according to claim 5 further including a code pattern of light reflecting and non-reflecting areas on the surface of the indicator such that the code pattern is detected by the sensor detecting the light reflected from the surface of the indicator as the carriage assembly reciprocates on the carriage guide rod.

8. An apparatus according to claim 7 wherein the location of the indicator within the ink cartridge corresponds to the quantity of ink in the ink cartridge and the location of the indicator is determined from the code pattern detected by the sensor.

9. The apparatus according to claim 8, wherein the code pattern on the surface of the indicator comprises a leading edge marker, an ink detecting area, adjacent to the leading edge marker, the width of the ink detecting area varying linearly from a substantially zero width at a bottom of the indicator to a maximum width at a top of the indicator, and a trailing edge marker adjacent to the ink detecting area.

10. The apparatus according to claim 8, wherein the code pattern on the surface of the indicator comprises a leading edge marker and an ink detecting area adjacent to the leading edge marker, the ink detecting area comprising a plurality of patterns of alternating reflecting and non-reflecting areas, each pattern having a distinct code corresponding to the location of the indicator within the ink cartridge.

11. The apparatus according to claim 7 wherein the surface of the indicator comprises a horizontally disposed predetermined code pattern of alternating light reflecting and non-reflecting areas located at one of the bottom and top sides of the surface.

12. The apparatus according to claim 7 wherein an output of the light sensor is stored in at least one of the printing mechanism and a connected computer.

13. The apparatus according to claim 5 wherein the ink cartridge further includes a channel retaining the indicator and connected to the ink reservoir for receiving a portion of the ink, the level of the ink in the channel corresponding to the quantity of the ink in the ink cartridge, wherein the indicator floats on the ink in the channel thereby attaining the location within the channel corresponding to the quantity of ink in the cartridge.

14. An apparatus according to claim 5 further including a flexible ink bag in the ink cartridge for holding the ink, the indicator being attached to the ink bag such that the indicator attains the location within the ink cartridge corresponding to the quantity of ink in the ink bag.

15. An apparatus according to claim 5 wherein the surface of the indicator includes a magnetic code pattern and the sensor is a magnetic sensor, whereby the magnetic sensor detects the magnetic code pattern as the carriage assembly reciprocates on the carriage guide rod.

16. An apparatus according to claim 15 wherein the location of the indicator within the ink cartridge corresponds to the quantity of ink in the ink cartridge, the location of the indicator in the ink cartridge being determined from the code pattern detected by the sensor.

17. The apparatus according to claim 16, wherein the code pattern comprises a leading edge marker, an ink detecting area adjacent to the leading edge marker, the width of the ink detecting area varying linearly from a substantially zero width at a bottom of the indicator to a maximum width at a top of the indicator, and a trailing edge marker, adjacent to the ink detecting area wherein the leading edge marker, the ink detecting area and the trailing edge marker comprise respectively one of a magnetic and a non-magnetic material.

18. The apparatus according to claim 16, wherein the surface of the indicator comprises a leading edge marker and an ink detecting area adjacent to the leading edge marker, the ink detecting area comprising a plurality of patterns of alternating magnetic and nonmagnetic areas, each pattern having a distinct code corresponding to the location of the indicator within the ink cartridge.

19. The apparatus according to claim 15 wherein the surface comprises a horizontally disposed predetermined code pattern of alternating magnetic and non-magnetic areas located at one of the bottom and top sides of the surface.

20. The apparatus according to claim 15 wherein the ink cartridge further includes a channel retaining the indicator and a portion of the ink, the level of the ink in the channel corresponding to the quantity of the ink in the ink cartridge, wherein the indicator floats on the ink in the channel thereby attaining a location within the channel corresponding to the quantity of ink in the cartridge.

21. The apparatus according to claim 15 further including a flexible ink bag for holding the ink in the ink cartridge, the indicator being attached to the ink bag such that the indicator attains the location within the ink cartridge corresponding to the quantity of ink in the ink bag.

22. The apparatus according to claim 15 wherein an output of the magnetic sensor is stored in at least one of the printing mechanism and a connected computer.

23. An ink cartridge for a printing mechanism comprising:

a reservoir holding ink; and a movable indicator internal to the ink cartridge, a location of the indicator corresponding to the quantity of ink in the reservoir, the indicator further including a code pattern on a surface of the indicator providing information about the location of the indicator and capable of being sensed by a magnetic sensor external to the ink cartridge, the code pattern comprising a leading edge marker, an ink-detecting area, adjacent to the leading edge marker, the width of the ink detecting area varying linearly from a substantially zero width at a bottom of the indicator to a maximum width at a top of the indicator, and a trailing edge marker, adjacent to the ink detecting area.

24. An ink cartridge for a printing mechanism comprising:

a reservoir holding ink; and a movable indicator internal to the ink cartridge, a location of the indicator corresponding to the quantity of ink in the reservoir, the indicator further including a code pattern on a surface of the indicator providing information about the location of the indicator and capable of being sensed by a magnetic sensor external to the ink cartridge, the code pattern comprising a leading edge marker and an ink detecting area, adjacent to the leading edge marker comprising a plurality of horizontally disposed patterns of alternating magnetic and non-magnetic areas, each horizontally disposed pattern having a distinct code corresponding to the location of the indicator within the ink cartridge.

25. An ink cartridge for a printing mechanism comprising:

a reservoir holding ink; and a movable indicator internal to the ink cartridge, a location of the indicator corresponding to the quantity of ink in the reservoir, the indicator further including a code pattern on a surface of the indicator providing information about the location of the indicator and capable of being sensed by a magnetic sensor external to the ink cartridge, wherein the code pattern is capable of being sensed by a magnetic sensor, the ink cartridge further including a horizontally disposed predetermined code pattern of alternating magnetic and non-magnetic areas located at one of the bottom and top sides of the surface.

26. An ink cartridge for a printing mechanism comprising:

a reservoir holding ink; and a movable indicator internal to the ink cartridge, a location of the indicator corresponding to the quantity of ink in the reservoir, the indicator further including a code pattern on a surface of the indicator providing information about the location of the indicator and capable of being sensed by a light sensor external to the ink cartridge when the code pattern is illuminated by light, the code pattern on the surface of the indicator comprising a leading edge marker extending over a first side of the surface, an ink detecting area, adjacent to the leading edge marker, the width of the ink detecting area varying linearly from a substantially zero width at a bottom of the indicator to a maximum width at a top of the indicator, and a trailing edge marker, adjacent to the ink detecting area.

27. An ink cartridge for a printing mechanism comprising:

a reservoir holding ink; and a movable indicator internal to the ink cartridge, a location of the indicator corresponding to the quantity of ink in the, the indicator further including a code pattern on a surface of the indicator providing information about the location of the indicator and capable of being sensed by a light sensor external to the ink cartridge when the code pattern is illuminated by light, the code pattern on the surface of the indicator comprising a leading edge marker extending over a first side of the surface, and an ink detecting area adjacent to the leading edge marker comprising a plurality of patterns of alternating light reflecting and non-light reflecting areas, each pattern having a distinct code corresponding to the location of the indicator within the ink cartridge.

28. An ink cartridge for a printing mechanism comprising:

a reservoir holding ink; and a movable indicator internal to the ink cartridge, a location of the indicator corresponding to the quantity of ink in the reservoir, the indicator further including a code pattern on a surface of the indicator providing information about the location of the indicator and capable of being sensed by a light sensor external to the ink cartridge when the code pattern is illuminated by light, the indicator further including a horizontally disposed predetermined code pattern of alternating light reflecting and non-light reflecting areas located at one of the bottom and top sides of the surface.

29. An ink cartridge for a printing mechanism comprising:

a reservoir holding ink; and a movable indicator internal to the ink cartridge, a location of the indicator corresponding to the quantity of ink in the reservoir wherein the ink cartridge further includes a channel retaining the indicator and a portion of the ink, the level of the ink in the channel corresponding to the quantity of the ink in the reservoir, wherein the indicator floats on the ink in the channel thereby attaining a location within the channel corresponding to the quantity of ink in the reservoir.

30. An apparatus for recording information about an ink cartridge installed in a printing mechanism comprising:

a movable indicator internal to the cartridge in fluid contact with ink stored in the ink cartridge for providing the information about the ink cartridge;

a sensor, separate from the ink cartridge, for receiving the information from the indicator; and a controller for receiving the information from the sensor and storing the information.

31. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator in fluid contact with the ink located within the ink cartridge, the indicator having a surface adjacent to the rear wall of the ink cartridge, the indicator, by its location in the ink cartridge, providing information about the ink cartridge; and a sensor for receiving the information from the indicator about the ink cartridge.

32. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator located wholly within the ink cartridge, the indicator having a surface adjacent to the rear wall of the ink cartridge, the indicator, by its location in the ink cartridge, providing information about the ink cartridge;

a sensor for receiving the information from the indicator about the ink cartridge; and a code pattern of light reflecting and non-reflecting areas on the surface of the indicator such that the code pattern is detected by the sensor detecting the light reflected from the surface of the indicator as the carriage assembly reciprocates on the carriage guide rod, wherein the location of the indicator within the ink cartridge corresponds to the quantity of ink in the ink cartridge and the location of the indicator is determined from the code pattern detected by the sensor; and wherein the code pattern on the surface of the indicator comprises a leading edge marker, an ink detecting area, adjacent to the leading edge marker, the width of the ink detecting area varying linearly from a substantially zero width at a bottom of the indicator to a maximum width at a top of the indicator, and a trailing edge marker adjacent to the ink detecting area.

33. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator located wholly within the ink cartridge, the indicator having a surface adjacent to the rear wall of the ink cartridge, the indicator, by its location in the ink cartridge, providing information about the ink cartridge;

a sensor for receiving the information from the indicator about the ink cartridge; and a code pattern of light reflecting and non-reflecting areas on the surface of the indicator such that the code pattern is detected by the sensor detecting the light reflected from the surface of the indicator as the carriage assembly reciprocates on the carriage guide rod, wherein the location of the indicator within the ink cartridge corresponds to the quantity of ink in the ink cartridge and the location of the indicator is determined from the code pattern detected by the sensor, and wherein the code pattern on the surface of the indicator comprises a leading edge marker and an ink detecting area adjacent to the leading edge marker, the ink detecting area comprising a plurality of patterns of alternating reflecting and non-reflecting areas, each pattern having a distinct code corresponding to the location of the indicator within the ink cartridge.

34. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator located wholly within the ink cartridge, the indicator having a surface adjacent to the rear wall of the ink cartridge, the indicator, by its location in the ink cartridge, providing information about the ink cartridge;

a sensor for receiving the information from the indicator about the ink cartridge; and a code pattern of light reflecting and non-reflecting areas on the surface of the indicator such that the code pattern is detected by the sensor detecting the light reflected from the surface of the indicator as the carriage assembly reciprocates on the carriage guide rod, wherein the surface of the indicator comprises a horizontally disposed predetermined code pattern of alternating light reflecting and non-reflecting areas located at one of the bottom and top sides of the surface.

35. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator located wholly within the ink cartridge, the indicator having a surface adjacent to the rear wall of the ink cartridge, the indicator, by its location in the ink cartridge, providing information about the ink cartridge; and a sensor for receiving the information from the indicator about the ink cartridge, wherein the ink cartridge further includes a channel retaining the indicator and connected to the ink reservoir for receiving a portion of the ink, the level of the ink in the channel corresponding to the quantity of the ink in the ink cartridge, wherein the indicator floats on the ink in the channel thereby attaining the location within the channel corresponding to the quantity of ink in the cartridge.

36. An apparatus for determining information about an ink cartridge installed in a printing mechanism comprising:

a carriage assembly reciprocating on a carriage guide rod, the ink cartridge being mounted on the carriage assembly for movement therewith, the ink cartridge including a rear wall and an ink reservoir for holding a quantity of ink;

a movable indicator located wholly within the ink cartridge, the indicator having a surface adjacent to the rear wall of the ink cartridge, the indicator, by its location in the ink cartridge, providing information about the ink cartridge; and a sensor for receiving the information from the indicator about the ink cartridge, wherein the surface of the indicator includes a magnetic code pattern and the sensor is a magnetic sensor, whereby the magnetic sensor detects the magnetic code pattern as the carriage assembly reciprocates on the carriage guide rod.

37. An apparatus according to claim 36, wherein the location of the indicator within the ink cartridge corresponds to the quantity of ink in the ink cartridge, the location of the indicator in the ink cartridge being determined from the code pattern detected by the sensor.

38. The apparatus according to claim 37, wherein the code pattern comprises a leading edge marker, an ink detecting area adjacent to the leading edge marker, the width of the ink detecting area varying linearly from a substantially zero width at a bottom of the indicator to a maximum width at a top of the indicator, and a trailing edge marker, adjacent to the ink detecting area wherein the leading edge marker, the ink detecting area and the trailing edge marker comprise respectively one of a magnetic and a non-magnetic material.

39. The apparatus according to claim 37, wherein the surface of the indicator comprises a leading edge marker and an ink detecting area adjacent to the leading edge marker, the ink detecting area comprising a plurality of patterns of alternating magnetic and non-magnetic areas, each pattern having a distinct code corresponding to the location of the indicator within the ink cartridge.

40. The apparatus according to claim 36, wherein the surface comprises a horizontally disposed predetermined code pattern of alternating magnetic and non-magnetic areas located at one of the bottom and top sides of the surface.

41. The apparatus according to claim 36, wherein the ink cartridge further includes a channel retaining the indicator and a portion of the ink, the level of the ink in the channel corresponding to the quantity of the ink in the ink cartridge, wherein the indicator floats on the ink in the channel thereby attaining a location within the channel corresponding to the quantity of ink in the cartridge.

42. The apparatus according to claim 36, further including a flexible ink bag for holding the ink in the ink cartridge, the indicator being attached to the ink bag such that the indicator attains the location within the ink cartridge corresponding to the quantity of ink in the ink bag.

43. The apparatus according to claim 36, wherein an output of the magnetic sensor is stored in at least one of the printing mechanism and a connected computer.

* * * * *